US011879255B2

(12) United States Patent
Rittmann et al.

(10) Patent No.: US 11,879,255 B2
(45) Date of Patent: Jan. 23, 2024

(54) DECOUPLING MAT AND FLOOR STRUCTURE, IN PARTICULAR IN A BUILDING WITH A DECOUPLING MAT

(71) Applicant: Gebrüder Jaeger GmbH, Wuppertal (DE)

(72) Inventors: Frank Rittmann, Wuppertal (DE); Johannes Wendt, Cologne (DE); Daniel Meckeler, Hagen (DE); Andrea Rücker, Wuppertal (DE)

(73) Assignee: Gebrüder Jaeger GmbH

( * ) Notice: Subject to any disclaimer, the term of this patent is extended or adjusted under 35 U.S.C. 154(b) by 143 days.

(21) Appl. No.: 16/918,695

(22) Filed: Jul. 1, 2020

(65) Prior Publication Data

US 2022/0003006 A1 Jan. 6, 2022

(51) Int. Cl.

| | |
|---|---|
| ***E04F 15/02*** | (2006.01) |
| ***E04F 15/18*** | (2006.01) |
| *E04F 15/16* | (2006.01) |

(52) U.S. Cl.

CPC ..... *E04F 15/185* (2013.01); *E04F 15/02* (2013.01); *E04F 15/16* (2013.01); *E04F 15/182* (2013.01); *E04F 15/186* (2013.01)

(58) Field of Classification Search

CPC ..... E04F 15/185; E04F 15/182; E04F 15/02; E04F 15/02161; E04F 15/022; E04F 15/16; E04F 15/18; E04F 15/186

See application file for complete search history.

(56) References Cited

U.S. PATENT DOCUMENTS

| | | | | | |
|---|---|---|---|---|---|
| 1,116,185 | A | * | 11/1914 | White | E04D 11/02 52/515 |
| 1,281,453 | A | * | 10/1918 | White | E04F 13/04 52/451 |
| 1,976,166 | A | * | 10/1934 | Fricdberg | E04B 1/644 52/250 |
| 2,154,734 | A | * | 4/1939 | Doing | E04D 13/147 52/302.6 |
| 2,977,103 | A | * | 3/1961 | Smith | F28F 25/087 261/111 |

(Continued)

FOREIGN PATENT DOCUMENTS

| | | | | |
|---|---|---|---|---|
| DE | 31 03 632 | A1 | 8/1982 | |
| DE | 3447054 | A1 * | 7/1986 | E04F 15/18 |

(Continued)

*Primary Examiner* — Phi D A

(74) *Attorney, Agent, or Firm* — Pandiscio & Pandiscio

(57) ABSTRACT

The invention relates to a decoupling mat (1) with a continuous plastic layer (2), for example one fabricated via deep drawing, comprising elongated, rib-like formations (3) on a first broadside ($B_1$), wherein the formations (3) simultaneously form groove-like recesses (5) on a second broadside ($B_2$) lying opposite the first broadside ($B_1$). In order to achieve a solution advantageous for use, emphasis is placed on having the formations (3) be bordered in their longitudinal extension (1) by sections (9) of a reduced height (h') and/or width (c'), which simultaneously also form partial areas (10) of less depth (s') and/or width (d') bordered relative to the recesses (5). In addition, the invention relates to a floor structure, in particular in a building with a decoupling mat (1).

18 Claims, 8 Drawing Sheets

(56) References Cited

U.S. PATENT DOCUMENTS

| | | | | | |
|---|---|---|---|---|---|
| 3,888,087 | A * | 6/1975 | Bergsland | E02D 31/02 | 405/36 |
| 4,320,073 | A * | 3/1982 | Bugler, III | F28F 25/087 | 261/DIG. 11 |
| 4,596,729 | A * | 6/1986 | Morrison | E04F 15/02161 | 52/180 |
| 4,917,933 | A * | 4/1990 | Schluter | E04B 1/762 | 428/167 |
| 5,052,161 | A * | 10/1991 | Whitacre | E04F 15/186 | 52/390 |
| 5,298,694 | A | 3/1994 | Thompson et al. | | |
| 5,390,467 | A | 2/1995 | Shuert | | |
| 5,460,867 | A * | 10/1995 | Magnuson | E01C 13/083 | 405/38 |
| 7,585,556 | B2 * | 9/2009 | Julton | E04F 15/18 | 52/302.1 |
| 8,221,856 | B2 | 7/2012 | Stroppiana | | |
| 8,516,760 | B2 | 8/2013 | Julton | | |
| 10,178,922 | B1 * | 1/2019 | Dasenbrock | A47G 27/0231 | |
| 10,383,470 | B2 * | 8/2019 | Weih | H04L 63/10 | |
| 2006/0260233 | A1 | 11/2006 | Schluter | | |
| 2008/0236077 | A1 | 10/2008 | O'Reilly | | |
| 2011/0232217 | A1 * | 9/2011 | Hartl | E04F 15/185 | 156/212 |
| 2012/0055108 | A1 * | 3/2012 | Bierwirth | E04F 15/182 | 52/403.1 |
| 2014/0202099 | A1 * | 7/2014 | Boyle | B32B 38/0004 | 52/747.11 |
| 2018/0017269 | A1 | 1/2018 | Houle et al. | | |
| 2019/0100925 | A1 * | 4/2019 | Pucilowski | E04F 15/12 | |
| 2020/0370307 | A1 * | 11/2020 | Kaiser | E04F 15/185 | |
| 2020/0392743 | A1 * | 12/2020 | Bennett | E04B 5/48 | |
| 2022/0003006 | A1 * | 1/2022 | Rittmann | E04F 15/185 | |

FOREIGN PATENT DOCUMENTS

| | | | | | |
|---|---|---|---|---|---|
| DE | 37 01 414 | C2 | | 9/1989 | |
| DE | 20 115 009 | | | 12/2001 | |
| DE | 299 24 180 | | | 5/2002 | |
| DE | 102 00 896 | | | 10/2002 | |
| DE | 202 09 869 | U1 | | 10/2003 | |
| DE | 202 10 177 | | | 11/2004 | |
| DE | 102006004626 | A1 | * | 8/2007 | B32B 27/065 |
| DE | 202008011351 | U1 | * | 12/2008 | E04F 15/185 |
| DE | 102011057125 | A1 | * | 7/2013 | E04F 15/182 |
| DE | 20 2012 105 080 | U1 | | 4/2014 | |
| DE | 20 2018 106 527 | | | 4/2020 | |
| EP | 0202846 | A1 | * | 11/1988 | E04F 15/18 |
| EP | 3 128 103 | A1 | | 2/2017 | |
| EP | 3 656 945 | | | 5/2020 | |
| WO | WO-8900227 | A | * | 1/1989 | E04F 15/185 |
| WO | WO 91/19782 | A1 | | 12/1991 | |
| WO | WO 93/01356 | A1 | | 1/1993 | |
| WO | WO 98/42176 | | | 10/1998 | |
| WO | WO 2015/161888 | | | 10/2015 | |
| WO | WO-2020206501 | A1 | * | 10/2020 | B32B 3/02 |

* cited by examiner

VII
E'
E
VI
d
d'
1
2
7
4
9
3
8
5
10
V
V
h'
h'
6
B2
c'
c
B1
b

O
U
1
B2
B1
t
s'
s
b

1
B2
B1
s'
s
L

DECOUPLING MAT AND FLOOR STRUCTURE, IN PARTICULAR IN A BUILDING WITH A DECOUPLING MAT

AREA OF TECHNOLOGY

The invention relates to a decoupling mat with a continuous plastic layer, for example one fabricated via deep drawing, comprising elongated, rib-like formations on a first broadside, wherein the formations simultaneously form groove-like recesses on a second broadside lying opposite the first broadside.

The invention further relates to a floor structure, in particular in a building with a decoupling mat, wherein the decoupling mat consisting of a continuous plastic layer has elongated, rib-like formations on a first broadside, for example fabricated via deep drawing, wherein the formations simultaneously form groove-like recesses on a second broadside lying opposite the first broadside.

PRIOR ART

For example, decoupling mats of the kind in question are known from DE 36 01 414 C2 and DE 105 41 547 A1. Such decoupling mats, which are also referred to as carrier mats, are also used in particular for laying ceramic coverings, for example tiles, via the thin-bed method.

SUMMARY OF THE INVENTION

In view of the prior art described above, the invention deals with the task of indicating an advantageous decoupling mat, with which a more advantageous floor structure can be achieved.

According to a first inventive idea, one possible solution to the task involves a decoupling mat where emphasis is placed on the formations being bordered in their longitudinal extension by sections of a reduced height and/or width, which simultaneously also form partial areas of less depth and/or width bordered relative to the recesses.

With respect to the floor structure, one possible solution to the task can involve having the formations be bordered in their longitudinal extension by sections of a reduced height and/or width, which simultaneously also form partial areas of less depth and/or width bordered relative to the recesses, and having the first broadside form an underside of the decoupling mat.

The proposed configuration of the decoupling mat yields formations bordered both with respect to their longitudinal extension as well as with respect to their width extension viewed transversely thereto, wherein the measure of the longitudinal extension can correspond to a multiple of the width extension, further preferably to three times, further preferably to five to ten times, possibly up to twenty times.

The sections of reduced height bordering the ends of a respective formation in the longitudinal extension can have a height that can correspond to 0.8 times or less, further to 0.5 times or less, up to 0.1 times the height of the formation viewed in the same direction, for example. The height can here be respectively dissipated in a direction perpendicular to the longitudinal extension as well as perpendicular to the width extension of the formation.

In particular the preferably film-like configuration of the plastic layer owing to its fabrication with the deep-drawing method can yield an at least approximately uniform material thickness of the plastic layer provided with the formations or recesses. As a further result, partial areas of a lesser depth and/or width bordering the recesses in a respective longitudinal direction are formed, allocated to the sections of reduced height in the area of the second broadside, wherein the dimensional correlation between in particular the lower depth of the partial area and the depth of the recess can essentially correspond to the ratio between the reduced height of the section and the height of a formation.

In such a configuration, the first broadside can be the underside of the decoupling mat in the use position, so that the formations can be aligned so as to face the raw floor or a screed layer, for example. The decoupling mat and floor structure provided over it at the conclusion can correspondingly be supported on the raw floor via the formations, for example.

Providing individual formations running correspondingly in a longitudinal direction not over the entire length of the plastic layer yields a favorable adjustment to the support surface that faces the plastic layer or decoupling mat, for example through an improved adjustment to smaller irregularities in the support surface. In addition, the proposed configuration in particular of the plastic layer can yield an overall improved handling while laying such a decoupling mat.

The decoupling mat designed in this way for transporting and possibly also for processing can further be provided as rolled goods. As also preferred, the rolling axis can be aligned in the longitudinal extension of the formations.

Additional features of the invention are often explained below, including in the description to the figures, in their preferred allocation to the subject matter of claim 1 and/or claim 2 or to features of additional claims. However, it could also be of importance as allocated to only individual features of claim 1 and/or claim 2 or the respective other claims or independently.

According to another possible configuration, the formations can transition transverse to their longitudinal extension on both sides into a groove that is continuous in relation to all formations provided one after the other in their longitudinal extension, and can have a constant depth over its length. In this way, the essentially continuous groove separates two mutually parallel running rows of formations arranged one next to the other directly transverse to the longitudinal extension, wherein cross connections can arise between the grooves running parallel to each other overall in the area of the sections of reduced height for the lengthwise bordering of the formations.

The decoupling mat can be used not just inside of buildings, but also outside of buildings, for example in a floor structure for balconies or terraces.

In the use position, this can further yield a floor structure in which a groove system facing the support surface for the decoupling mat arises between the support surface and the decoupling mat that is continuous both in the longitudinal extension direction and in a direction of extension transverse thereto, doing so in particular as a result of an overall partial support of the decoupling mat via the lengthwise bordered formations. The resultant hollow structure can form a system of interconnected vapor pressure equalizing channels that extends over the entire surface.

As also preferred, each groove can have a uniform depth over its entire length, wherein the respective dimension relates to an extension perpendicular to a plane that contacts the formations in their highest extension, for example given a formation with a barrel-like cross section in the area of the zenith. In the assembly situation, this plane can be the support surface, for example of the raw floor, facing the formations.

With respect to the second broadside that faces upward in the assembly situation, a groove can simultaneously form a continuous wall relative to all recesses formed one after the other in its longitudinal extension, which has a uniform height over its length. The wall can laterally border the formations and recesses arranged sequentially in the longitudinal extension. The height of the wall can here relate to a plane that contacts the walls of the plastic layer in the area of its highest vertical extension and correspondingly does not pass through the walls, wherein the height can be measured perpendicular to this plane up to a parallel running plane in the area of the greatest depth of the recesses.

The formations or recesses can be arranged offset relative to each other transverse to their longitudinal extension. As also preferred, this can further yield a corresponding displacement of the sections of reduced height and/or width or the partial areas of less depth and/or width.

A respective straight extension of the grooves can further arise in the longitudinal direction, while the cross connection of the grooves, including groove sections, can meander overall, for example.

According to another preferred embodiment, a section or partial area can here be arranged roughly centrally in relation to a longitudinal extension of a formation or a recess. Given preferably equally long formations or recesses, this can further yield an arrangement of these formations or recesses in a group.

The sections or partial areas can also be arranged transverse to the longitudinal extensions of the formations or recesses as viewed along a geometric line running perpendicular to a longitudinal direction.

With respect to all grooves, a shared, continuous, planar geometric surface can be set up, which without passing through the formations extends below the greatest height of the formations and above the sections of reduced height, wherein partial surfaces allocated to the respective groove arise, and connecting surfaces in the area of the sections of reduced height. This can correspondingly yield a geometric surface, whose elongated, continuous surface sections are connected with each other in the area of the recesses by transversely running partial surfaces and connecting surfaces formed by these partial surfaces, so that a grid-like, geometric surface can arise overall in this regard.

With respect to two walls lying directly opposite each other, only one continuous, planar, geometric cover surface can be set up, which is separated from an adjacent cover surface and without passing through the walls runs below the greatest height of the walls, wherein partial sections allocated to the respective recess arise and connecting sections in the vicinity of partial areas of reduced depth. Accordingly, a plurality of geometric cover surfaces can arise in this way, preferably corresponding to the number of recesses, which can be connected in a chain-like manner and arranged one behind the other in the longitudinal extension via partial sections allocated to a respective recess, which overall can form connecting sections.

The first and/or second broadside of the decoupling mat can also be covered with a nonwoven layer. The nonwoven layer can be connected with the plastic layer, for example adhesively bonded or laminated.

The one or both nonwoven layers can here further be arranged with their contours adjusted to the formations and/or recesses, so that, with reference to a view on one of the broadsides, the geometric formations or recesses described above can arise, along with partial areas of reduced depth and/or width or sections of reduced height and/or width, even given the placement of a fleece layer.

If provided for, one nonwoven layer, but possibly also both nonwoven layers, can alternatively be arranged in a stretched alignment, correspondingly arranged roughly in one plane. A dotted or linear fixation of the fleece layer can fit closely in the area of the highest extension of the formations, for example, or further in the area of the highest extension of the walls, for example.

Given an arrangement of a fleece layer on both the first and on the second broadside, these fleece layers can be identically designed, possibly with identical material thicknesses. With respect to the material, various fleece layers can in this regard be provided, and/or ones that vary in material thickness.

With regard to the disclosure, the areas or value ranges or multiple ranges indicated above and below also include all intermediate values, in particular in 1/10 increments of the respective dimension, i.e., also dimensionless if necessary. For example, the indication 0.8 times or less also incorporates the disclosure of 0.7 times or less, 0.9 times or less, etc., the disclosure of 0.5 to 1 mm also incorporates the disclosure of 0.6 to 1 mm, 0.5 to 0.9 mm, 0.6 to 0.9 mm, etc., the disclosure of 1.5 to 4 times also incorporates the disclosure of 1.6 to 4 times, 1.5 to 3.9 times, 1.6 to 3.9 times, etc. This disclosure can be used on the one hand to limit a specified range boundary from below and/or above, but alternatively or additionally to disclose one or several singular values from a respectively indicated range.

BRIEF DESCRIPTION OF THE DRAWINGS

The invention will be described below based on the attached drawing, with the latter only containing exemplary embodiments. A part that is explained only in relation to one of the exemplary embodiments and not replaced by another part in an additional exemplary embodiment based on the feature emphasized therein is thus also described as a part that is in any event possibly present for this additional exemplary embodiment. The drawing shows.

DESCRIPTION OF THE EMBODIMENTS

Figure 1:
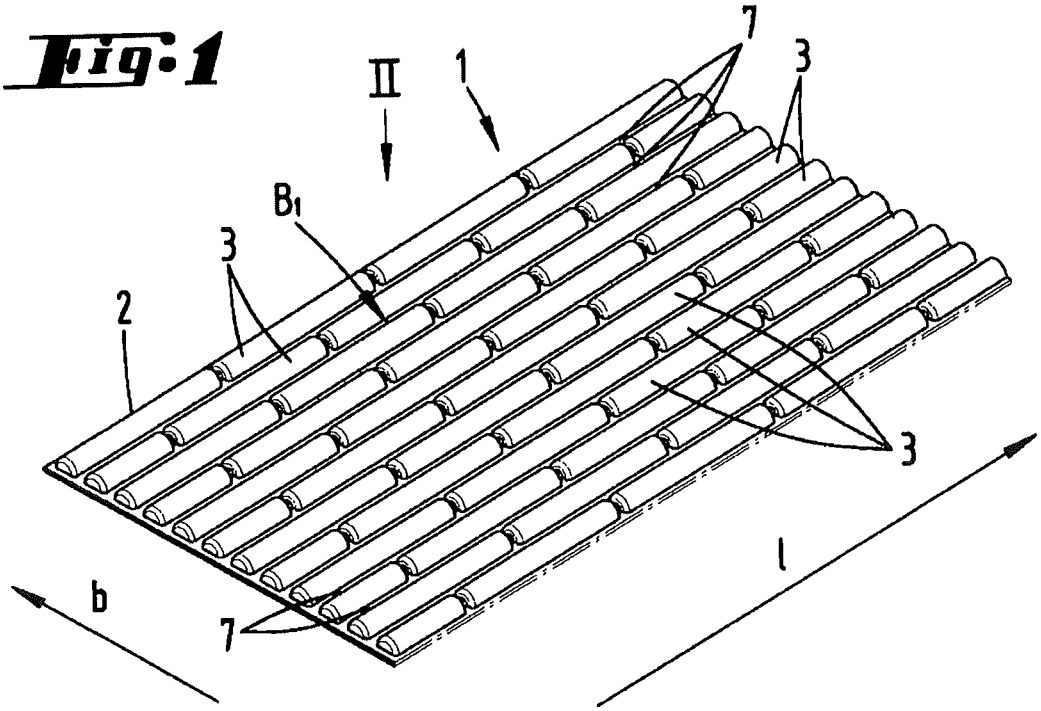
FIG. 1 a perspective illustration of a plastic layer of a decoupling mat with a view on a first broadside.
Figure 2:
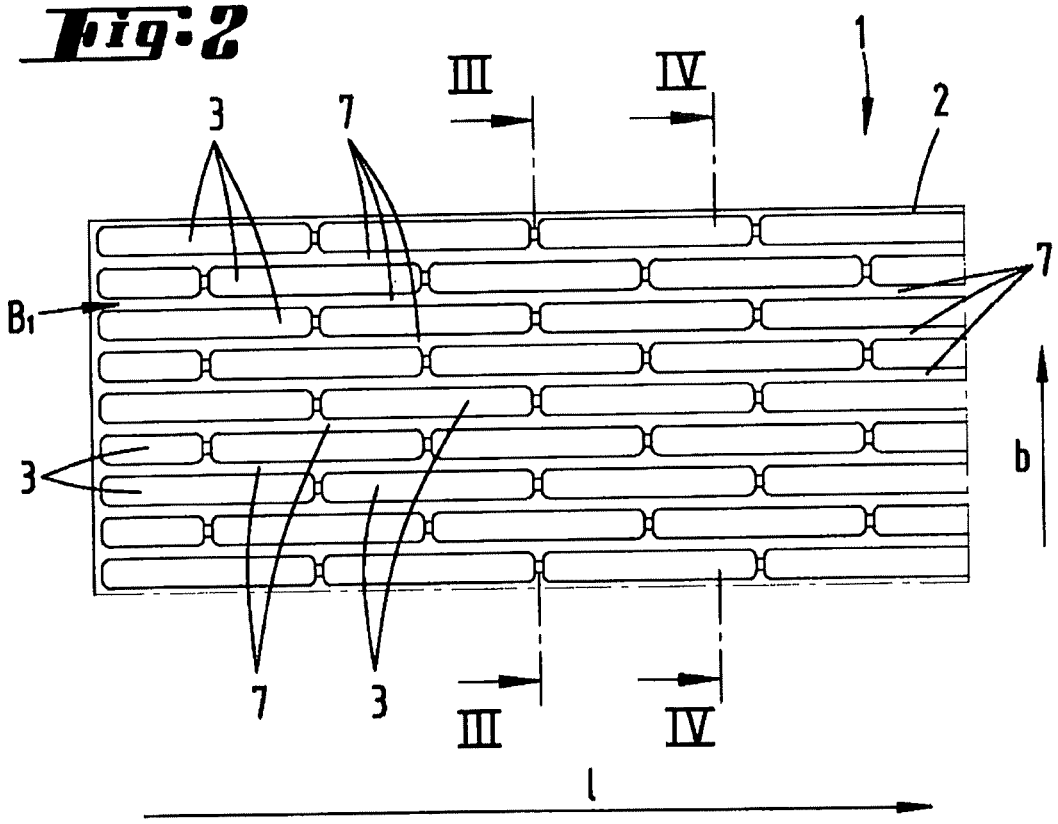
FIG. 2 a top view according to arrow II on FIG. 1.

Initially with reference to the illustration on FIG. 1, a decoupling element 1 is shown and described, which according to the first embodiment depicted on FIGS. 1-9 can consist solely of a plastic layer 2. As will be described in even more detail further below, a fleece layer 20 and/or 21 can alternatively be provided on one or both sides of the plastic layer 2 (see FIGS. 10 and 11).

The plastic layer 2 can be fabricated through deep drawing, for example, and has a longitudinal extension 1 as well as a width extension b viewed transversely thereto.

The plastic layer 2 has rib-like formations 3 that were elongated in the longitudinal extension 1, for example as the result of deep drawing. According to the sectional view on FIG. 3, these can be at least approximately semicircular in design in a cross section transverse to the longitudinal extension 1, with a surface 4 that faces a first broadside $B_1$ of the plastic layer 2.

As also illustrated, the plastic layer 2 can have an essentially constant material thickness a over the entire longitudinal extension 1 and the entire width extension b. This material thickness a can measure roughly 0.2 mm or more, for example, and further 0.5 mm up to 1 mm or 2 mm, for example.

Figure 3:
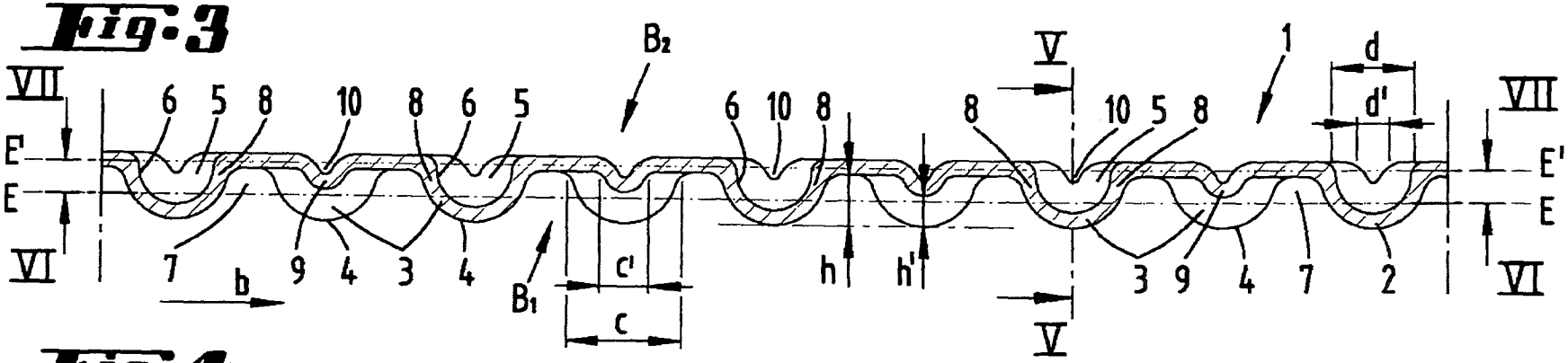
FIG. 3 the magnified section according to line III-III on FIG. 2.
Figure 4:
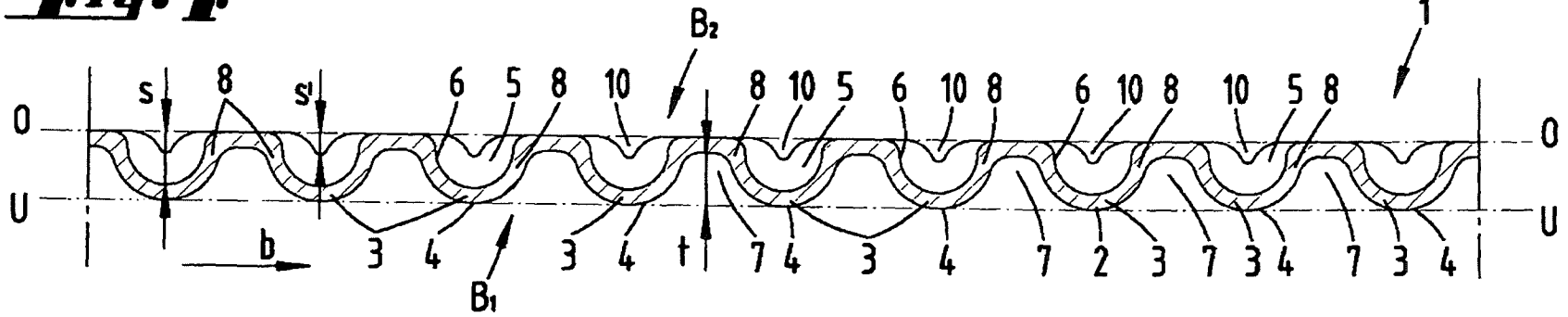
FIG. 4 the magnified section according to line IV-IV on FIG. 2.
Figure 5:
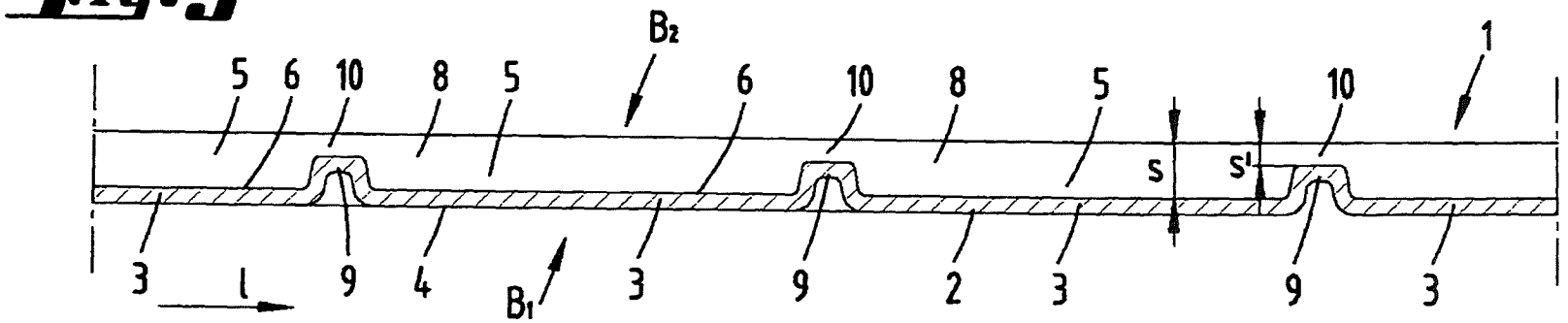
FIG. 5 the section according to line IV-IV on FIG. 3.

A respective groove-like recess 5 with an interior surface 6 that possibly runs concentrically to the surface 4 in the cross section according to FIG. 3 arises on the second broadside $B_2$ lying opposite the first broadside $B_1$ in the area of the formations 3.

The formations 3 are arranged one after the other in a chain-like manner as viewed in the direction of longitudinal extension 1. The individual formation rows preferably run parallel to each other, wherein a groove 7 that is continuous relative to all formations 3 generated one after the other in their longitudinal extension remains between two rows of formations 3 running one right next to the other, and hence on both sides of the formations 3, transverse to their longitudinal extension. This groove 7 preferably extends along a straight line, doing so with a depth t that stays constant over the length in the longitudinal extension 1, wherein this depth t is dissipated perpendicular to a plane U that contacts the formations 3 in the area of their respective zenith on the surface 4.

With respect to all formations 3 generated one after the other in their longitudinal extension, each groove 7 simultaneously forms a wall 8 on both sides that appears continuous on the second broadside $B_2$, wherein the wall 8 transitions into the wall comprising the formations 3 on the first broadside $B_1$ in a longitudinal extension 1 with interruptions.

Each formation 3 is bordered in its longitudinal extension 1 by sections 9 of reduced height and, in the exemplary embodiment shown, of reduced width as well. As viewed in the width extension b, the section 9 can here have a width extension dimension c' that can correspond to roughly one fourth to one half, further for example to one third, of the largest width extension dimension c of a formation 3 as viewed in the same direction.

The height h of each formation 3 perpendicular to the plane U can further correspond to 1.5 to 4 times, for example, further roughly to 2 to 3 times, for example, of the reduced height h' of the section 9 that connects the formations 3 in a longitudinal direction (see FIG. 3).

With respect to the recesses 5, correspondingly in relation to the second broadside $B_2$, these connecting sections simultaneously form bordered partial areas 10 of less depth s' and possibly also less widths d' viewed transverse to the longitudinal extension 1, wherein this depth s' can correspond to roughly one fifth to one half, further for example to one fourth or one third, of the depth s of a recess 5. The respective depth s, s' is dissipated perpendicular to a plane O, which runs parallel to the plane U in the area of the second broadside $B_2$ and contacts the plastic layer 2 in areas arising in the transition of the walls 8 into the partial areas 10 or in the transition to the wall of an adjacent recess 5. The reduced width d' can correspond to roughly 0.2 to 0.7 times, for example to 0.5 times, the largest width d of a recess as viewed transverse to the longitudinal extension 1.

As also shown, the formations 3 that are separated from each other by the sections 9 in the longitudinal extension 1, but by all means connected with each other in a chain-like manner by the sections 9, can have identical formation lengths, and further preferably identical widths c as viewed transversely thereto as well.

The rows of formations 3 can also be arranged offset relative to each other as viewed in the longitudinal extension in such a way that yields a "gap" arrangement in relation to the sections 9.

A section 9 can further be arranged between two formations 3 arranged one behind the other, roughly centrally relative to the longitudinal extension of a formation 3 of an adjacent formation row.

Accordingly, this type of offset arrangement can also be provided relative to the partial areas 10 that connect the recesses 5 in series.

The trough-like recesses 5 of a row are further connected with each other in an overflow manner by the partial areas 10 below the plane O. As a result of the wall 8 that runs in a longitudinal extension 1—due to the continuous groove 7 on the opposing broadside—the recesses 5 of one row are separated from the recesses 5 of the directly adjacent row.

The arrangement and dimensional shaping or spacing of the formations 3 can further be selected in such a way that a plane E running parallel to the planes U or O can be set up according to the schematic illustration on FIG. 6, which extends below the largest height of the recesses 5 in the plane U and above the sections 9 of reduced height h' (see also FIG. 3).

Figure 6:
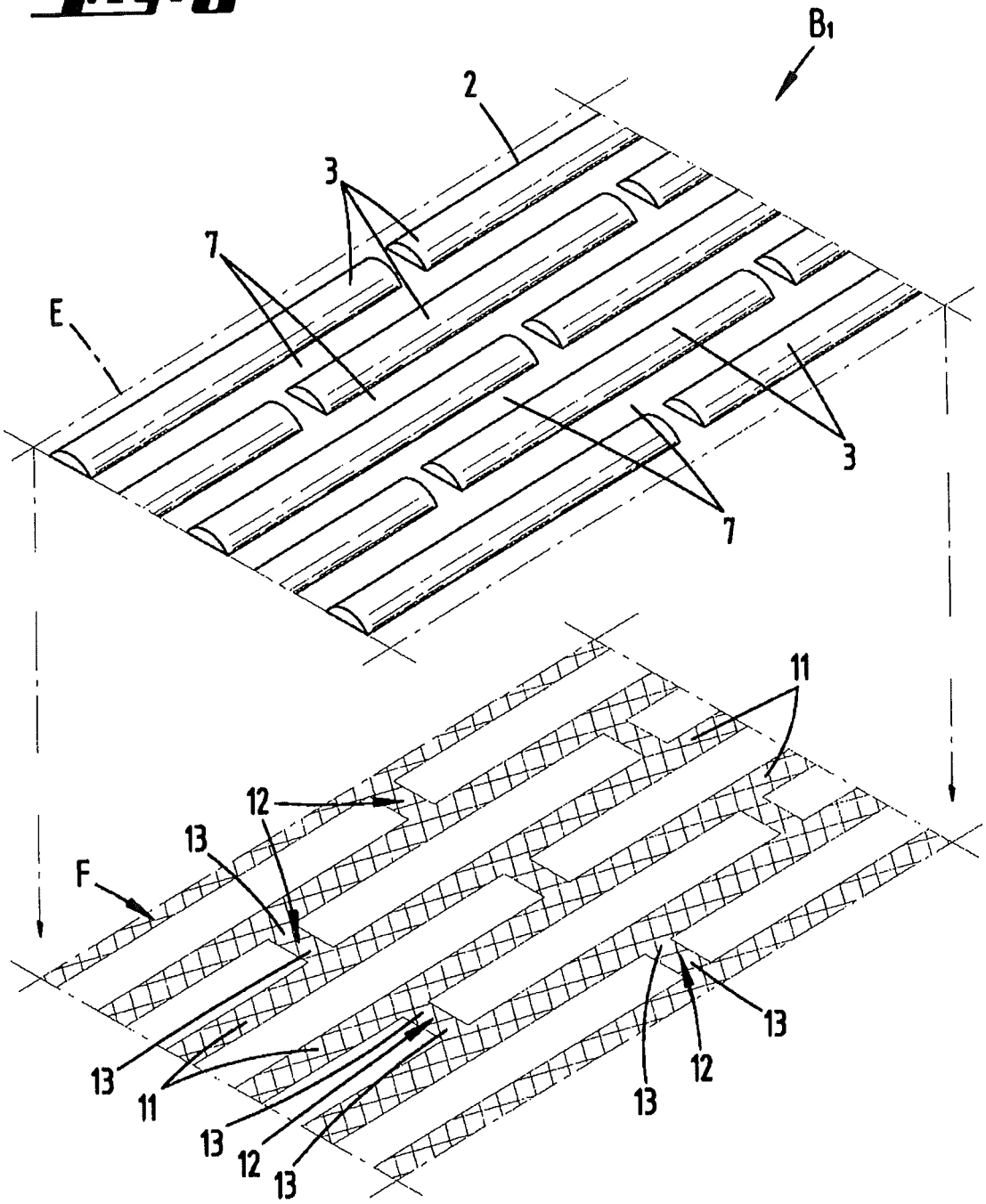
FIG. 6 a magnified cutout depicting a schematic, perspective sectional view along plane E on FIG. 3, with geometric plane E set up to clarify the configuration and a projected geometric surface F resulting therefrom.
Figure 7:
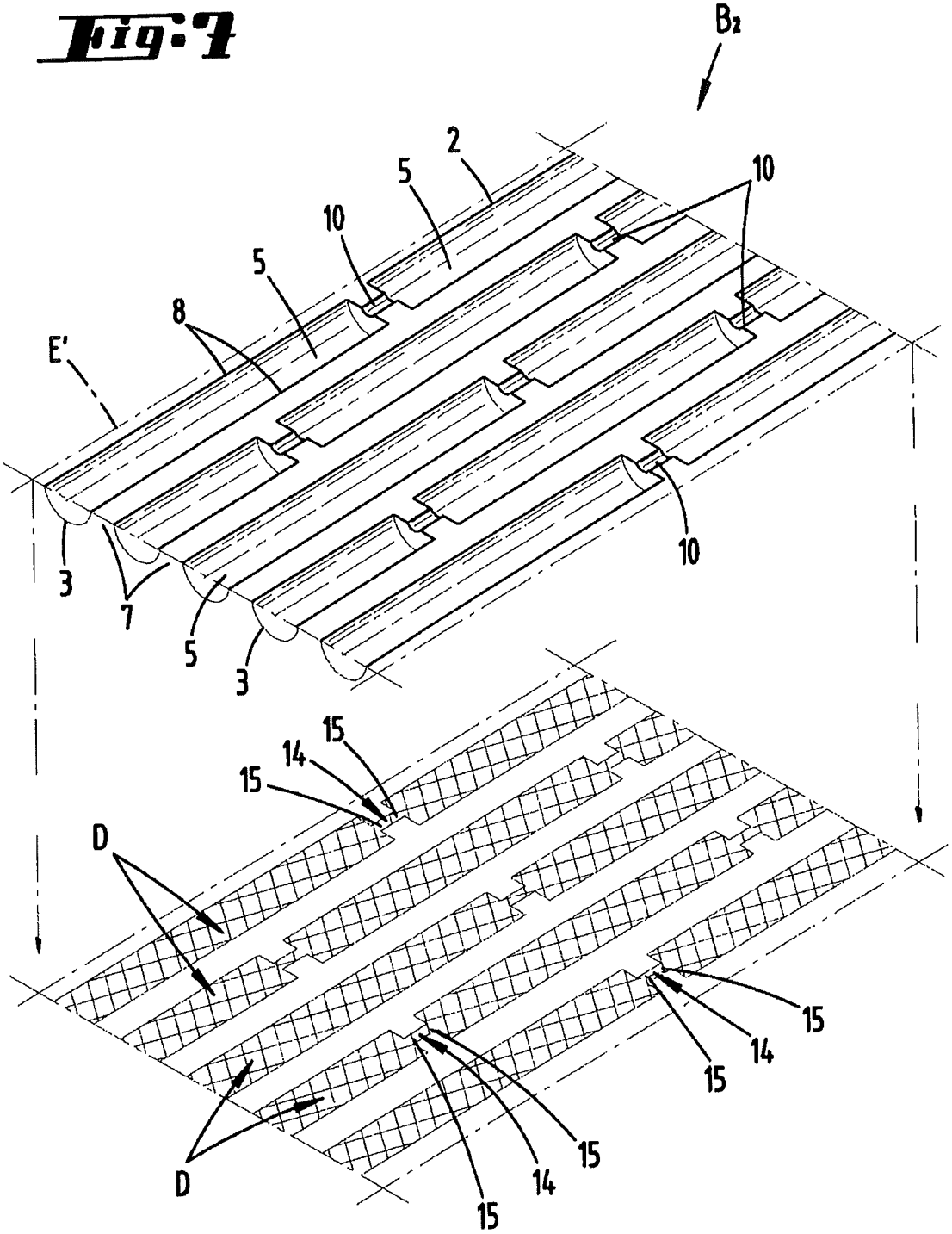
FIG. 7 a magnified cutout depicting a schematic, perspective sectional view along plane E' on FIG. 3, with geometric plane E' set up to explain the configuration of the plastic layer and projected geometric cover surfaces D arising therefrom.

As evident from FIG. 6, this type of an arrangement of a geometric plane E yields an island-like emersion of formations 3 above the plane E over roughly half their height extension h.

The remaining surface F between the formations 3 that is projected perpendicular to the plane E can correspondingly have a grid-like structure, with free surfaces 11 that run between two adjacently running formations 3, and hence cover the groove 7 in the longitudinal extension, and are connected with each other in the area of sections 9 of reduced height h' by connecting surfaces 12 running transversely thereto. These connecting surfaces 12 arise from partial surfaces 13, which each arise allocated to a groove 7.

With respect to an additional geometric plane E' that is aligned parallel to the plane E described above and aligned in such a way as to pass through both the recesses 5 and the partial areas 10 of less depth s', a continuous, planar geometric cover surface D can arise in a perpendicular projection between two walls 8 lying one directly opposite the other (see FIG. 7), which is separated from an adjacent cover surface by the wall 9.

Corresponding to the plane E', this cover surface D runs below a largest height of the wall 8.

The cover surfaces D of a row of recesses 5 arranged one after the other in a longitudinal extension are connected with each other in a chain-like manner in the partial areas 10 of less depth s' via connecting sections 14, wherein a connecting section 14 consists of partial sections 15 allocated to the respective recess 5.

Figure 8:
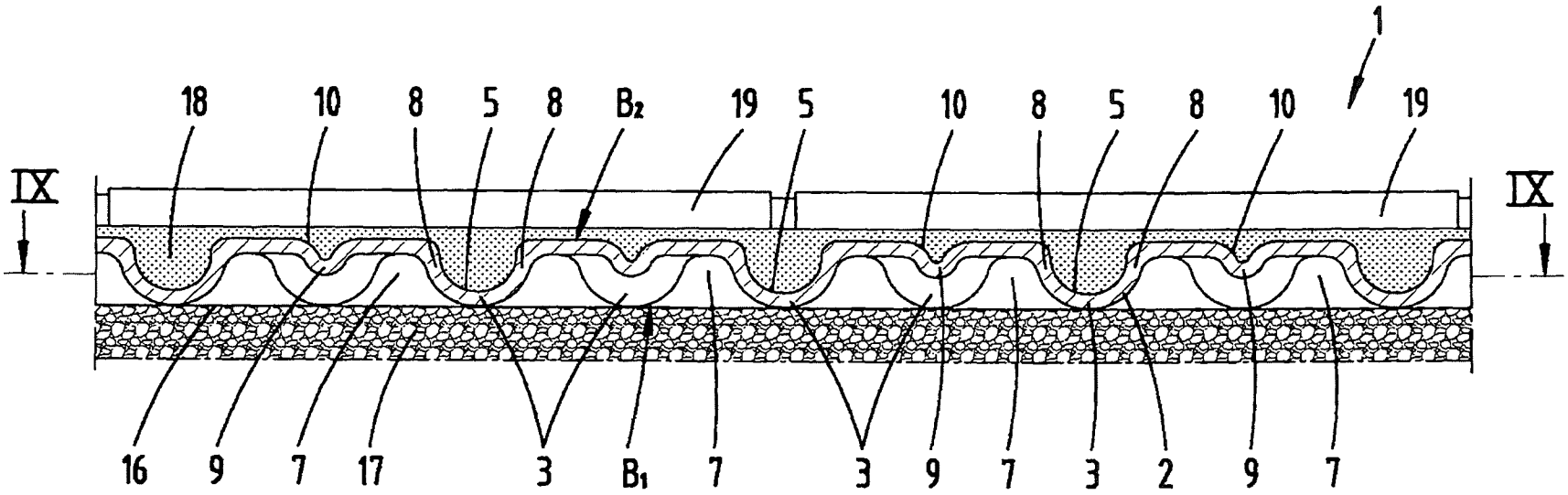
FIG. 8 a sectional view according to FIG. 3, but relative to a floor structure using a decoupling mat according to FIG. 1.
Figure 9:
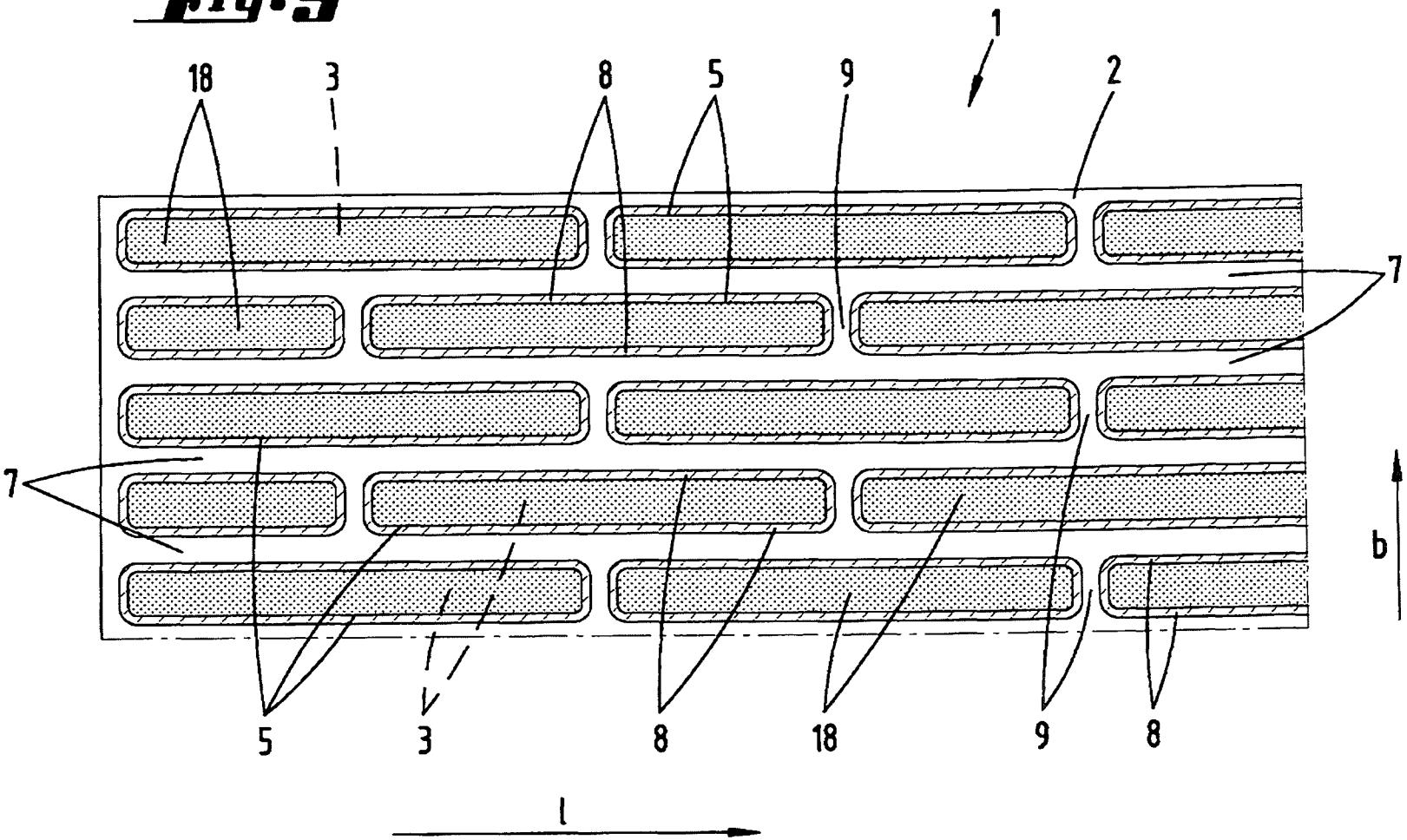
FIG. 9 the section according to line IX-IX on FIG. 8.

As evident from the assembly situation shown on FIG. 8, the first broadside $B_1$ comprises the underside of the decoupling mat 1. Accordingly, the surface 4 of the formations 3 faces downward in the direction of a support surface 16 of the floor 17. A roughly linear support for the decoupling mat 1 over the zenith areas of the formations 3 on the support surface 16 can here arise. In any event, the configuration described above only yields a small interrupted support in the area of the formations 3. The grooves 7 are also connected with each other in the use position according to FIG. 8 by the sections 9 of less height h'.

An adhesive mortar 18 can be directly applied to the upper side of the plastic layer 2 formed by the second broadside $B_2$, for purposes of adhesively fixing ceramic and stoneware tiles 19, for example.

The adhesive mortar 18 here reaches into the depressions in the area of the recesses 5, as well as into the depth s' reduced by the partial areas 10, thereby yielding a good bond.

In particular to increase the adhesive or bonding strength, a fleece layer 20, 21 can be provided on one or both sides, i.e., correspondingly on the top and/or bottom side of the plastic layer 2.

As also preferred, the fleece layer 20 allocated to the second broadside $B_2$—corresponding to the upper side—can be provided adjusted to the contour of the surface of the plastic layer 2, and correspondingly also line the recesses 5, and further preferably also the partial areas 10 of reduced depth s'.

Figure 10:
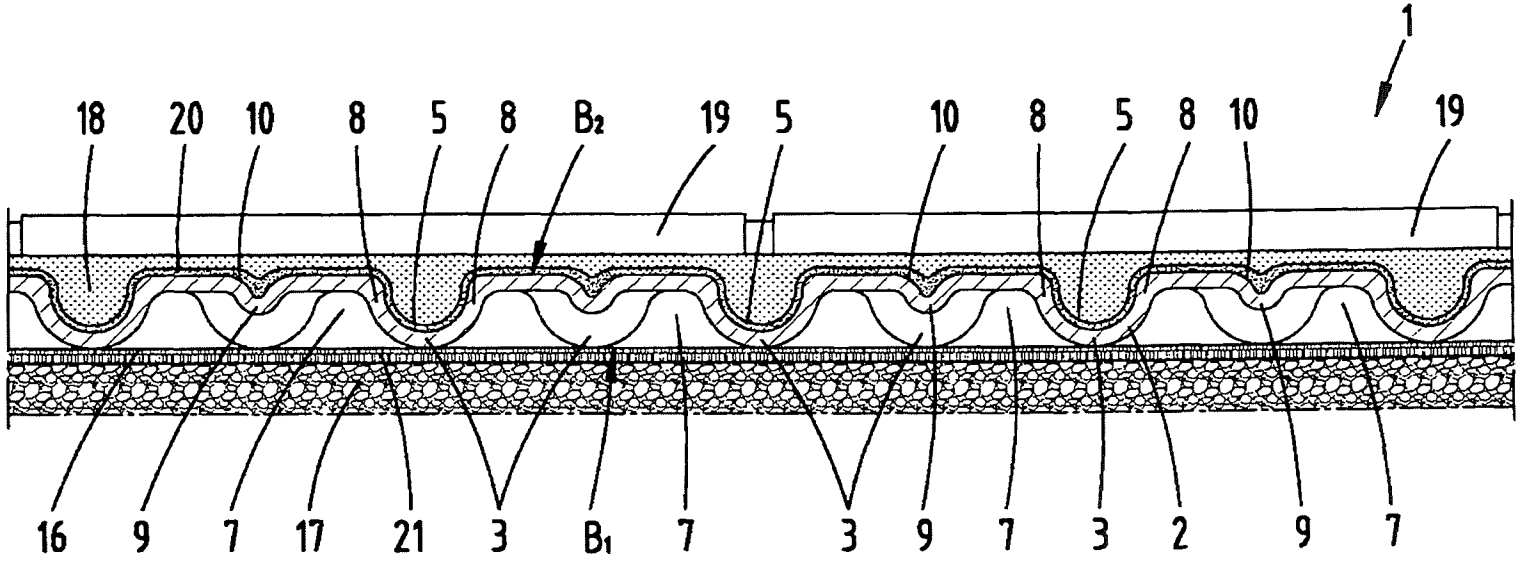
FIG. 10 an illustration corresponding to FIG. 8, but relating to a second embodiment.
Figure 11:
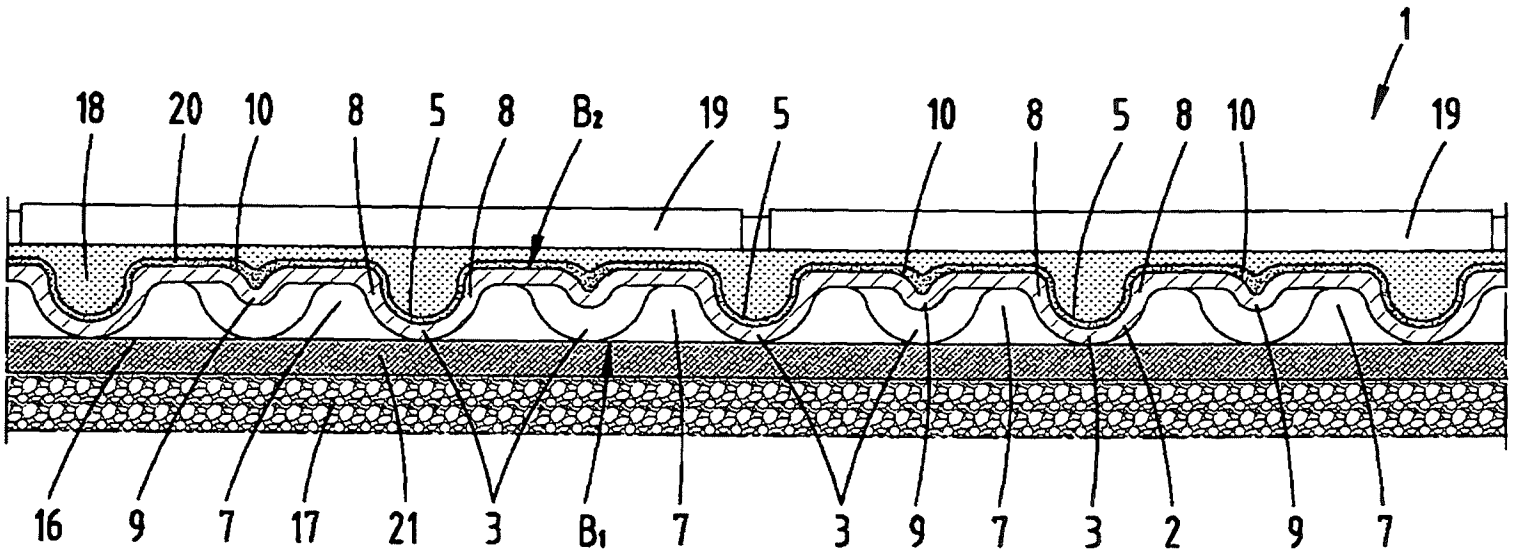
FIG. 11 another illustration corresponding to FIG. 8, relating to a third embodiment.

The upper fleece layer 20 can have a thickness corresponding to the material thickness a of the plastic layer 2, or a thickness reduced by comparison to this thickness, as shown on FIGS. 10 and 11.

As preferred, a possibly provided lower fleece layer 21 can be stretched out and extend into a plane (preferably plane U), and correspondingly preferably lies only tangentially against the surface 4 in the area of the formations 3, and is there further preferably also bonded to the plastic layer 2.

The lower fleece layer 21 can be used to adhesively fix the decoupling mat 2 configured in this way to the floor 17, wherein the hollow structure under the plastic layer 2 resulting from the formation of the grooves 7 and partial areas 10 is retained owing to the arrangement of the lower fleece layer 21 described above.

The material thickness selected for the lower fleece layer 21 can be identical to that of the upper fleece layer 20. FIG. 10 shows a lower fleece layer 21, the thickness of which can correspond roughly to the material thickness a of the plastic layer 2.

The lower fleece layer 21 can also serve as a decoupling fleece, and according to the illustration on FIG. 11 can further have a significantly larger thickness than the upper fleece layer 20, and further possibly also than the plastic layer 2, e.g., double or triple the thickness of the plastic layer 2.

The above statements serve to explain the inventions encompassed by the application as a whole, which further develop the prior art at least by the following feature combinations, each even independently, wherein two, several or all of these feature combinations can also be combined, specifically:

A decoupling mat, characterized in that the formations 3 are bordered in their longitudinal extension 1 by sections 9 of a reduced height h' and/or width c', which simultaneously also form partial areas 10 of less depth s' and/or width d' bordered relative to the recesses 5.

A floor structure, characterized in that the formations 3 are bordered in their longitudinal extension 1 by sections 9 of a reduced height h' and/or width c', which simultaneously also form partial areas 10 of less depth s' and/or width d' relative to the recesses 5, and that the first broadside $B_1$ forms an underside of the decoupling mat 1.

A decoupling mat or a floor structure, characterized in that the formations 3 transition transverse to their longitudinal extension 1 on both sides into a groove 7 that is continuous in relation to all formations 3 provided one after the other in their longitudinal extension 1, and has a constant depth t over its length.

A decoupling mat or a floor structure, characterized in that a groove 7 simultaneously forms a continuous wall 8 relative to all recesses 5 formed one after the other in its longitudinal extension 1, which has a uniform height h over its length.

A decoupling mat or a floor structure, characterized in that the formations 3 or recesses 5 are arranged offset relative to each other transverse to their longitudinal extension 1.

A decoupling mat or a floor structure, characterized in that a section 9 or partial area 10 is arranged roughly centrally in relation to a longitudinal extension 1 of a formation 3 or a recess 5.

A decoupling mat or a floor structure, characterized in that, with respect to all grooves 7, a shared, continuous, planar geometric surface F can be set up, which without passing through the formations 3 extends below the greatest height h of the formations 3 and above the sections 9 of reduced height h', with partial surfaces 13 allocated to the respective groove 7, and connecting surfaces 12 in the area of the sections 9 of reduced height h'.

A decoupling mat or a floor structure, characterized in that, with respect to two walls lying directly opposite each other, only one continuous, planar, geometric cover surface D can be set up, which is separated from an adjacent cover surface D, and without passing through the walls 8 runs below the greatest height of the walls 8, with partial sections 15 allocated to the respective recess 5 and connecting sections 14 in the vicinity of partial areas 10 of less depth s'.

A decoupling mat or a floor structure, characterized in that the first and/or second broadside $B_1$, $B_2$ of the decoupling mat 1 is covered with a nonwoven layer 20, 21.

All disclosed features are essential to the invention (separately, but also in combination). The disclosure of the application hereby also completely incorporates the disclosure content of the accompanying/attached priority documents (copy of preliminary application), also for the purpose of including features of these documents in claims of the present application. Even without the features of a referenced claim, the subclaims with their features characterize separate inventive further developments of prior art, in particular so as to generate partial applications based upon these claims. The invention indicated in each claim can additionally have one or several of the features indicated in the above specification, in particular those provided with reference numbers, and/or in the reference list. The invention also relates to embodiments in which individual features mentioned in the above specification have not been realized, in particular to the extent they are obviously unnecessary for the respective intended application or can be replaced by other technically equivalent means.

REFERENCE LIST

| Reference List | |
|---|---|
| 1 | Decoupling mat |
| 2 | Plastic layer |
| 3 | Formation |
| 4 | Surface |
| 5 | Recess |
| 6 | Interior surface |
| 7 | Groove |
| 8 | Wall |
| 9 | Section |
| 10 | Partial area |
| 11 | Free surface |
| 12 | Connecting surface |
| 13 | Partial surface |
| 14 | Connecting section |
| 15 | Partial section |
| 16 | Support surface |
| 17 | Floor |
| 18 | Adhesive mortar |
| 19 | Tiles |
| 20 | Fleece layer |
| 21 | Fleece layer |
| A | Material thickness |
| b | Material thickness |
| c | Width |
| c' | Width |
| d | Width |
| d' | Width |
| h | Height |
| h' | Height |
| l | Longitudinal extension |
| s | Depth |
| s' | Depth |
| t | Depth |
| $B_1$ | First broadside |
| $B_2$ | Second broadside |
| D | Cover surface |
| E | Plane |
| E' | Plane |
| F | Surface |
| O | Plane |
| U | Plane |

The invention claimed is:

1. A decoupling mat comprising a continuous plastic layer, wherein the continuous plastic layer (2) comprises elongated formations on a first broadside, with the formations (3) simultaneously forming recesses (5) on a second broadside ($B_2$) lying opposite the first broadside ($B_1$), wherein the formations (3) are bordered in their longitudinal extension (1) by sections (9) of a reduced height (h') and a reduced width (c'), which simultaneously also form partial areas (10) of a reduced depth (s') and a reduced width (d') bordered relative to the recesses (5), wherein a measure of a longitudinal extension of the formations corresponds to a multiple of a width extension of the formations, wherein the formations and recesses are arranged offset relative to each other transverse to their longitudinal extension, and further wherein, with respect to two walls (8) of a recess (5), the walls are disposed directly opposite each other.

2. The decoupling mat according to claim 1, wherein the formations (3) transition transverse to their longitudinal extension (1) on both sides into a groove (7) that is continuous in relation to all formations (3) provided one after the other in their longitudinal extension (1), and has a constant depth (t) over its length.

3. The decoupling mat according to claim 1, wherein a groove (7) simultaneously forms a continuous wall (8) relative to all recesses (5) formed one after the other in its longitudinal extension (1), which has a uniform height (h) over its length.

4. The decoupling mat according to claim 1, wherein a section (9) or partial area (10) is arranged roughly centrally in relation to a longitudinal extension (1) of a formation (3) or a recess (5).

5. The decoupling mat according to claim 2, wherein, with respect to all grooves (7), a shared, continuous, planar geometric surface (F) can be set up, which without passing through the formations (3) extends below the greatest height (h) of the formations (3) and above the sections (9) of reduced height (h'), with partial surfaces (13) allocated to the respective groove (7), and connecting surfaces (12) in the area of the sections (9) of reduced height (h').

6. The decoupling mat according to claim 1, wherein the first and/or second broadside ($B_1$, $B_2$) of the decoupling mat (1) is covered with a nonwoven layer (20, 21).

7. The decoupling mat according to claim 3, wherein, with respect to all grooves (7), a shared, continuous, planar geometric surface (F) can be set up, which without passing through the formations (3) extends below the greatest height (h) of the formations (3) and above the sections (9) of reduced height (h'), with partial surfaces (13) allocated to the respective groove (7), and connecting surfaces (12) in the area of the sections (9) of reduced height (h').

8. The decoupling mat according to claim 1, wherein the continuous plastic layer (2) is fabricated via deep drawing.

9. The decoupling mat according to claim 1, wherein the reduced depth (s') corresponds to one fifth to one half of the depth (s') of a recess (5) and the reduced width (d') corresponds to 0.2 to 0.7 times the largest width (d') of a recess (5).

10. A floor structure comprising a continuous plastic layer (2) having elongated formations (3) on a first broadside ($B_1$), wherein the formations (3) simultaneously form recesses (5) on a second broadside ($B_2$) lying opposite the first broadside ($B_1$), wherein the formations (3) are bordered in their longitudinal extension (1) by sections (9) of a reduced height (h') and a reduced width (c'), which simultaneously also form partial areas (10) of reduced depth (s') and a reduced width (d') relative to the recesses (5), and that the first broadside ($B_1$) forms an underside of the floor structure, wherein a measure of a longitudinal extension of the formations corresponds to a multiple of a width extension of the formations, wherein the formations and recesses are arranged offset relative to each other transverse to their longitudinal extension, and further wherein, with respect to two walls (8) of a recess (5), the walls are disposed directly opposite each other.

11. The floor structure according to claim 10, wherein the formations (3) transition transverse to their longitudinal extension (1) on both sides into a groove (7) that is continuous in relation to all formations (3) provided one after the other in their longitudinal extension (1), and has a constant depth (t) over its length.

12. The floor structure according to claim 10, wherein a groove (7) simultaneously forms a continuous wall (8) relative to all recesses (5) formed one after the other in its longitudinal extension (1), which has a uniform height (h) over its length.

13. The floor structure according to claim 10, wherein a section (9) or partial area (10) is arranged roughly centrally in relation to a longitudinal extension (1) of a formation (3) or a recess (5).

14. The floor structure according to claim 11, wherein, with respect to all grooves (7), a shared, continuous, planar geometric surface (F) can be set up, which without passing through the formations (3) extends below the greatest height (h) of the formations (3) and above the sections (9) of reduced height (h'), with partial surfaces (13) allocated to the respective groove (7), and connecting surfaces (12) in the area of the sections (9) of reduced height (h').

15. The floor structure according to claim 12, wherein, with respect to all grooves (7), a shared, continuous, planar geometric surface (F) can be set up, which without passing through the formations (3) extends below the greatest height (h) of the formations (3) and above the sections (9) of reduced height (h'), with partial surfaces (13) allocated to the respective groove (7), and connecting surfaces (12) in the area of the sections (9) of reduced height (h').

16. The floor structure according to claim 10, wherein the first and/or second broadside ($B_1$, $B_2$) is covered with a nonwoven layer (20, 21).

17. The floor structure according to claim 10, wherein the continuous plastic layer (2) is fabricated via deep drawing.

18. The floor structure according to claim 10, wherein the reduced depth (s') corresponds to one fifth to one half of the depth (s') of a recess (5) and the reduced width (d') corresponds to 0.2 to 0.7 times the largest width (d') of a recess (5).

* * * * *